US008753070B2

(12) United States Patent
Elorza Gomez

(10) Patent No.: US 8,753,070 B2
(45) Date of Patent: Jun. 17, 2014

(54) DEVICE AND METHOD FOR REDIRECTING A LEAKAGE CURRENT

(75) Inventor: Sergio Elorza Gomez, Munich (DE)

(73) Assignee: MTU Aero Engines GmbH, Munich (DE)

( * ) Notice: Subject to any disclaimer, the term of this patent is extended or adjusted under 35 U.S.C. 154(b) by 909 days.

(21) Appl. No.: 12/920,071

(22) PCT Filed: Feb. 19, 2009

(86) PCT No.: PCT/DE2009/000229

§ 371 (c)(1),
(2), (4) Date: Nov. 23, 2010

(87) PCT Pub. No.: WO2009/106045

PCT Pub. Date: Sep. 3, 2009

(65) Prior Publication Data

US 2011/0058933 A1 Mar. 10, 2011

(30) Foreign Application Priority Data

Feb. 28, 2008 (DE) ..... 10 2008 011 746

(51) Int. Cl.
*F01D 11/00* (2006.01)
*F01D 5/08* (2006.01)

(52) U.S. Cl.
USPC ..... 415/115; 415/168.2; 415/168.4

(58) Field of Classification Search
USPC ..... 415/52.1, 58.4, 58.5, 58.6, 58.7, 115, 415/168.1, 168.2, 168.4, 173.7, 174.5; 416/174, 175, 193 A, 224, 239
See application file for complete search history.

(56) References Cited

U.S. PATENT DOCUMENTS

| | | | | |
|---|---|---|---|---|
| 3,291,447 | A * | 12/1966 | Brandon | 415/111 |
| 3,746,462 | A * | 7/1973 | Fukuda | 415/115 |
| 4,152,092 | A | 5/1979 | Swearingen | |
| 4,465,429 | A | 8/1984 | Martin et al. | |
| 4,672,727 | A * | 6/1987 | Field | 29/889.721 |
| 5,151,012 | A * | 9/1992 | Hough | 416/95 |
| 5,211,533 | A * | 5/1993 | Walker et al. | 415/115 |
| 5,429,478 | A * | 7/1995 | Krizan et al. | 415/173.7 |
| 7,503,748 | B2 * | 3/2009 | Ferra et al. | 416/97 R |
| 7,597,536 | B1 * | 10/2009 | Liang | 415/138 |
| 7,946,808 | B2 * | 5/2011 | Taylor et al. | 415/173.7 |
| 8,038,399 | B1 * | 10/2011 | Liang | 416/95 |
| 8,043,046 | B2 * | 10/2011 | Guemmer | 415/115 |
| 8,186,938 | B2 * | 5/2012 | Young et al. | 415/115 |
| 8,202,039 | B2 * | 6/2012 | Guemmer | 415/55.5 |

(Continued)

FOREIGN PATENT DOCUMENTS

| | | |
|---|---|---|
| EP | 1 574 670 A2 | 9/2005 |
| GB | 2 110 767 A | 6/1983 |

(Continued)

OTHER PUBLICATIONS

EPO Office Action dated Jan. 21, 2014 (Five (5) pages).

*Primary Examiner* — Edward Look
*Assistant Examiner* — Christopher R Legendre
(74) *Attorney, Agent, or Firm* — Crowell & Moring LLP

(57) ABSTRACT

A device for redirecting a leakage current flowing between a stator and a rotor is disclosed. The device includes a sealing element for interrupting the leakage current, an outlet opening disposed on the rotor, and a guide which is configured to direct the leakage current past the sealing element to the outlet opening.

13 Claims, 4 Drawing Sheets

(56) References Cited

U.S. PATENT DOCUMENTS

| | | | | |
|---|---|---|---|---|
| 8,282,341 | B2 * | 10/2012 | Freeman et al. | 415/115 |
| 2005/0201857 | A1 * | 9/2005 | Ferra et al. | 415/115 |
| 2008/0145208 | A1 * | 6/2008 | Klasing et al. | 415/173.7 |
| 2010/0254802 | A1 * | 10/2010 | Freeman et al. | 415/115 |
| 2011/0058933 | A1 * | 3/2011 | Elorza Gomez | 415/168.2 |

FOREIGN PATENT DOCUMENTS

| | | | | | |
|---|---|---|---|---|---|
| GB | 2 119 027 | A | | 11/1983 | |
| GB | 2165007 | A | * | 4/1986 | F01D 11/00 |
| GB | 2 298 245 | A | | 8/1996 | |
| JP | 57013201 | A | * | 1/1982 | F01D 5/18 |
| JP | 60-159304 | A | | 8/1985 | |
| WO | WO 02/25066 | A1 | | 3/2002 | |

* cited by examiner

DEVICE AND METHOD FOR REDIRECTING A LEAKAGE CURRENT

This application claims the priority of International Application No. PCT/DE2009/000229, filed Feb. 19, 2009, and German Patent Document No. 10 2008 011 746.3, filed Feb. 28, 2008, the disclosures of which are expressly incorporated by reference herein.

BACKGROUND AND SUMMARY OF THE INVENTION

The present invention relates to a device and a method for redirecting a leakage current flowing between a stator and a rotor, which can be used for example in conjunction with an axial compressor. The invention furthermore relates to a rotor as well as a compressor comprising a corresponding device.

Gas turbines can have a compressor in which a rotor may rotate in relation to a stationary stator. In order to minimize leakage currents between the rotating rotor and an inner cover band of the stationary stator, a sealing arrangement designated as an "inner air seal" may be used. In spite of such a sealing arrangement, a relatively small quantity of air flowing back under the inner cover bands of the compressor stators cannot be avoided. The re-entry of this low-energy leakage mass flow into the main channel of the compressor causes a thickening of the hub boundary layer. As a result, the stability of the compressor and its efficiency are impaired.

In order to reduce this detrimental effect from the leakage mass flow, efforts may be made to minimize the mass flow. To this end, more effective sealing systems may be installed. However, a minimal leakage is necessary and unavoidable so that the rotor does not heat up too much.

It is therefore the objective of the present invention to make available a device and a method for redirecting a leakage current flowing between a stator and a rotor, which is able to reduce the undesired effects of the leakage current. Moreover, it is the objective of the present invention to make available a compressor with a corresponding device.

The present invention is based on the knowledge that the detrimental effects of the leakage mass flow may be reduced or avoided if the leakage current is blown off further upstream from the stator. As a result, the leakage current has more time to intermix with a main flow before it reaches the stator. In this way, it is possible to flow against the stator with a healthier boundary layer. Furthermore, the approach according to the invention offers the possibility that the leakage current may be injected into the main current with greater energy, wherein the injection direction can be varied and optimized. As a result, the intermixing may be improved and the hub boundary layer may become thinner. In addition, the pulsating flow may have a stabilizing effect on the stator.

According to the invention, the detrimental effects of the leakage flows in the area of the inner air seals can be reduced, in that the leakage flows are re-introduced further upstream. In this way, the re-entry of the leakage mass flow may be optimized such that the re-entry does not occur in the gap between the rotor platform and the stator platform.

A device according to the invention for redirecting a leakage current flowing between a stator and a rotor includes a sealing element for interrupting the leakage current, an outlet opening disposed on the rotor and a guide which is configured to direct the leakage current past the sealing element to the outlet opening.

In an advantageous embodiment of the device according to the invention, the guide may be configured to provide a defined injection direction for the leakage current at the outlet opening. By specifying a defined injection direction, it is possible to optimize the intermixing of the leakage current with the main flow.

Furthermore, the guide may have a channel leading through a rotor platform of the rotor, which channel is connected to the outlet opening. It is possible to easily integrate the channel into an existing rotor platform. In addition, a desired outflow direction and outflow energy for the leakage current may be adjusted through the channel.

For example, the outlet opening may be disposed in a rotor platform of the rotor. As a result, it is possible for the leakage current to blow off upstream from the stator.

In an advantageous embodiment of the device according to the invention, the rotor may have an extension, which is configured to bridge a gap extending in the radial direction between the rotor and stator, wherein the sealing element may be disposed on a stator-side end of the extension. It is possible to prevent a re-entry of the leakage current into the gap between rotor and stator in this way.

The guide may be configured to direct the leakage current to go along between a rotor shaft of the rotor and the extension. Thus, a radially lower area of the extension may serve as a guide for the leakage current.

For example, the sealing element may abut an inner cover band of the stator, wherein a distance of the sealing element to a radially outer end of the inner cover band is greater than or equal to a distance of the sealing element to a radially inner end of the inner cover band.

Alternatively, the sealing element may abut an inner cover band of the stator, wherein a distance of the sealing element to a radially outer end of the inner cover band is less than a distance of the sealing element to a radially inner end of the inner cover band.

In an advantageous embodiment of the device according to the invention, the outlet opening may be disposed in a hub surface and/or a front surface of the rotor. This makes it possible to realize an advantageous injection of the leakage current.

In doing so, a distance of the outlet opening from an edge of the hub surface facing away from the stator may be greater than a distance of the outlet opening from an edge of the hub surface facing the stator.

For example, the outlet opening may also be disposed on an edge of the hub surface facing the stator.

Furthermore, the outlet opening may be disposed between two rotor blades of the rotor, wherein the outlet opening may be disposed closer to the one of the two rotor blades which, in relation to a rotational direction of the rotor, is disposed behind the outlet opening.

For example, the outlet opening may have a round cross section. This type of cross section may be realized in a simple manner by a borehole.

Alternatively, the outlet opening may be configured as a slot. Such a formation may be advantageous for example if the outlet opening is disposed on the edge of the rotor platform.

In an advantageous embodiment of the device according to the invention, the device may comprise at least one other outlet opening disposed on the rotor and at least one other guide, wherein the at least one other guide is configured to direct at least a portion of the leakage current past the sealing element to the at least one other outlet opening. As a result, a re-entry of the leakage current can be distributed uniformly.

A rotor according to the invention may comprise a device according to the above. In this way, the device according to the invention may be combined with a rotor or be integrated into the rotor.

A compressor according to the invention may comprise a rotor according to the invention and a stator, wherein the rotor is disposed upstream of the stator in relation to a main flow in the compressor. As a result, the approach according to the invention can be used advantageously in conjunction with compressors such as those used in gas turbines for example.

A method according to the invention for redirecting a leakage current flowing between a stator and a rotor has a step of interrupting the leakage current with a sealing element and a step of directing the leakage current past the sealing element to an outlet opening disposed on the rotor.

Additional advantages, features and details of the invention are disclosed in the following description of a graphically depicted exemplary embodiment.

DETAILED DESCRIPTION OF THE DRAWINGS

The same or similar elements are designated in the figures using the same reference numbers.

Figure 1:
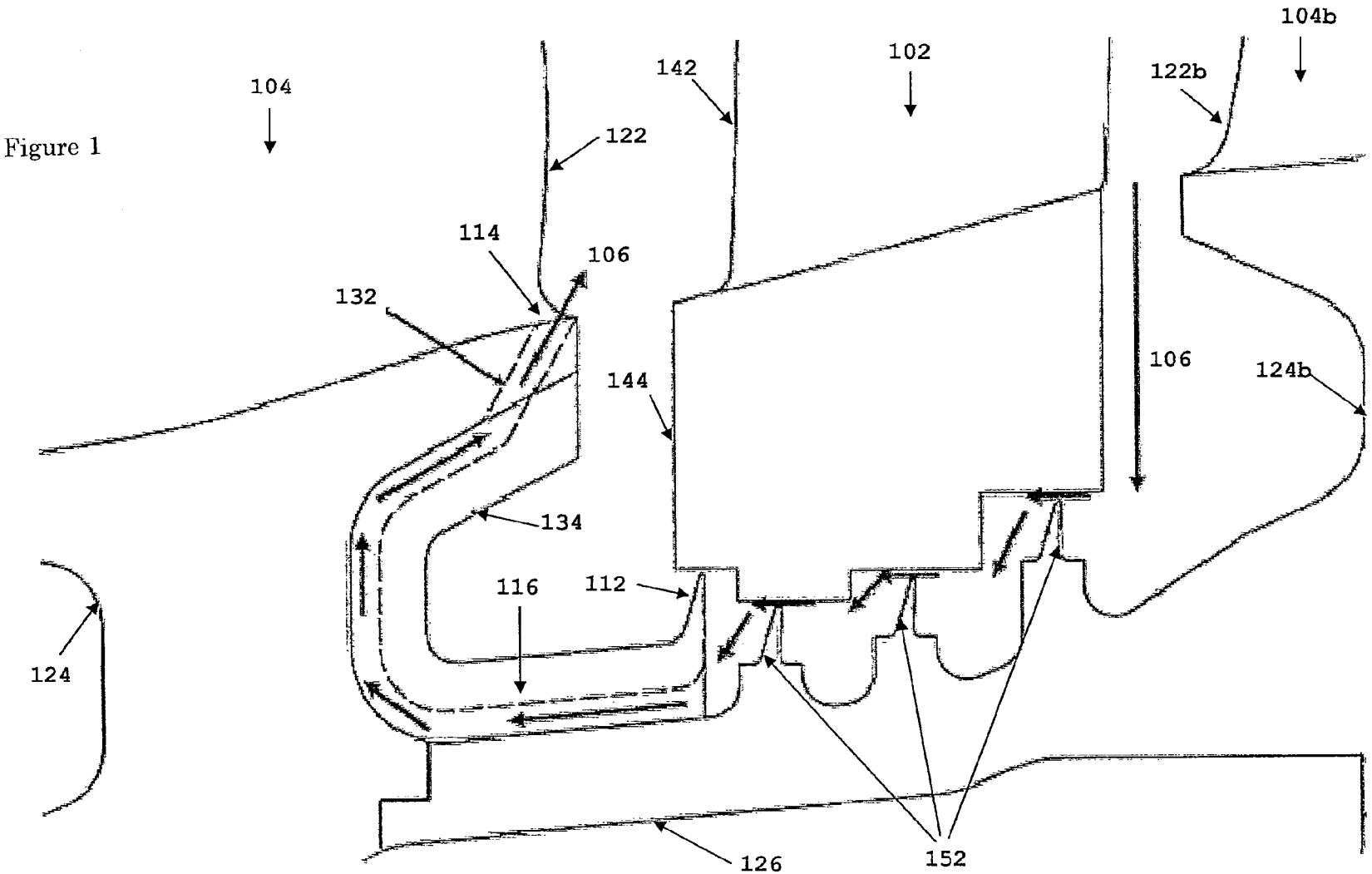
FIG. 1 is a schematic representation of a device according to the invention in a compressor.

FIG. 1 shows a schematic representation of a device for redirecting a leakage current 106 flowing between a stator 102 and a rotor 104 according to an exemplary embodiment of the present invention. A flow of the leakage current 106 is represented by a sequence of arrows. For the sake of clarity, only the first and the last arrows of the leakage current 106 are provided with a reference number in FIG. 1. As depicted in FIG. 1, the device according to the invention may be used in conjunction with a compressor such as those used in a gas turbine for example.

The device according to the invention features a sealing element 112 for interrupting the leakage current 106, an outlet opening 114 disposed on the rotor 104 and a guide 116. The guide 116 is configured to direct the leakage current 106 past the sealing element 112 to the outlet opening 114. In relation to a main flow, which may be produced or intensified by a rotational movement of the rotor 104, the rotor 104 is disposed upstream in relation to the stationary stator 102. The guide 116 may be configured in the area of the outlet opening 114 in such a way that the leakage current 106 exiting from the outlet opening 114 is provided with a pre-determined injection direction. According to this exemplary embodiment, the injection direction has a first and a second directional component, wherein the first directional component points in the direction of the main flow and the second directional component points radially outwardly. In addition, there may be a circumferential component.

The rotor 104 may have a plurality of rotor blades 122. Only one rotor blade 122 is depicted in FIG. 1. The rotor blade 122 is disposed pointing radially outwardly to a rotor platform 124. The rotor platform 124 may be coupled to another rotor 104*b* via a rotor shaft 126. The other rotor 104*b* also has rotor blades 122*b*, which are disposed on another rotor platform 124*b*. The rotors 104, 104*b* may be designed as blisks (bladed disks). In the case of a blisk, the blades and the disks form one unit and are no longer produced separately from one another.

According to this exemplary embodiment, the rotor platform 124 has at least one slot 132. The slot 132 shown in FIG. 1 forms a channel through the rotor platform 124. The slot 132 is a part of the guide 116 and is configured to direct the leakage current 106 to the outlet opening 114 in the rotor platform 124.

The stator 102 may have a plurality of stationary stator blades 142, which are connected to a stator inner cover band 144. FIG. 1 shows just one stator blade 142, which is connected to the stator inner cover band 144. There is a gap extending in the radial direction between the stator inner cover band 144 and the rotor platform 124. According to the invention, an entry of the leakage current 106 into this gap is avoided. To this end, the rotor platform 124 may have an attachment 134 to direct the flow. The attachment 134 may be configured as an extension of the rotor platform, which allows the gap to be bridged and sealed. To seal the gap, the sealing element 112 may be disposed on a stator-side end of the extension 134. As a result, the sealing element 112 is able to bring about an interruption and redirection of the leakage current 106 into the guide 116. The leakage current 106 may thus be directed past the sealing element 112, going along between the rotor shaft 126 and the extension 134 to the channel 132 in the rotor platform 124.

According to this exemplary embodiment, the sealing element 112 abuts a radially inner step of the stator inner cover band 144. The step is configured such that the sealing element 112 seals the gap between the rotor platform 124 and the stator inner cover band 144 in the vicinity of the rotor shaft 126. In this way, a distance of the sealing element 112 to a radially outer end of the stator inner cover band 144 is greater than a distance of the sealing element 112 to a radially inner end of the stator inner cover band 144.

Additional sealing devices 152 may be disposed in a circumferential gap between the rotor shaft 126 and the stator inner cover band 144. Three additional sealing devices 152 are shown in FIG. 1. The leakage current 106 flows from a gap between the stator 102 and the other rotor 104*b* past the other sealing devices 152 in the direction of the sealing element 112. Any sealing arrangements that are suitable for sealing the gap between the stator inner cover band 144 and the rotor shaft 126 may be used for the additional sealing devices 152 and for the sealing element 112.

Figure 2:
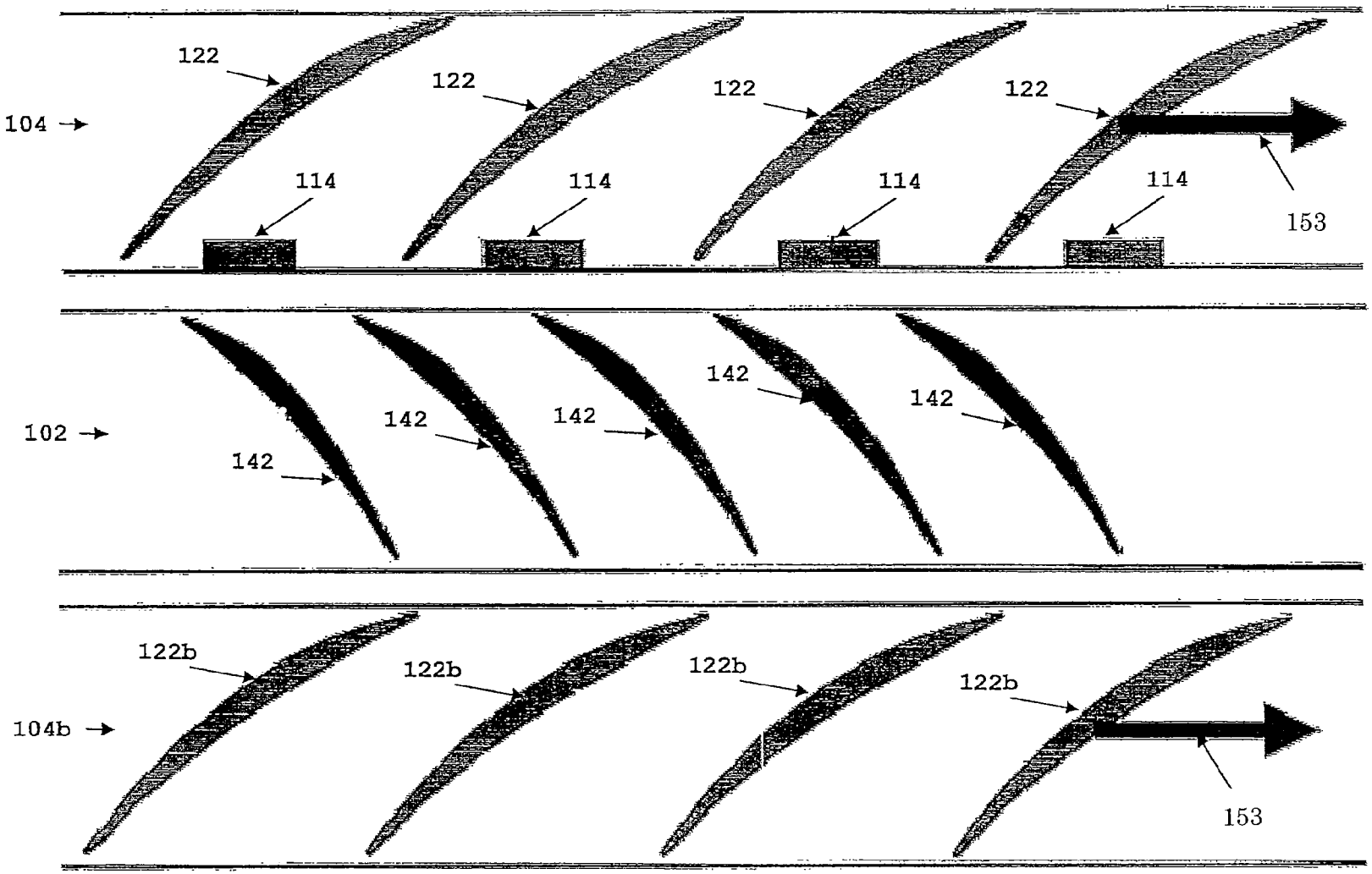
FIG. 2 is another schematic representation of the device depicted in FIG. 1.

FIG. 2 shows another schematic representation of the rotor 104 depicted in FIG. 1, of the stator 102 and of the other rotor 104*b*. The rotors 104, 104*b* have a plurality of rotor blades 122, 122*b*. The stator 102 has a plurality of stator blades 142.

According to this exemplary embodiment, an outlet opening 114 is respectively disposed between two rotor blades 122. The outlet openings 114 may be disposed in this case in a rotor hub surface of the rotor 104. According to this exemplary embodiment, the outlet openings 114 are formed as rectangular slots. The outlet openings 114 are disposed on that edge of the rotor hub surface that is facing the stator 102.

The outlet openings 114 may be disposed between two rotor blades 122 such that an outlet opening 114 is respectively disposed closer to the one of the two adjacent rotor blades 122, which, in relation to a rotation direction 153 of the rotor, is disposed behind the outlet opening 114.

Figure 3:
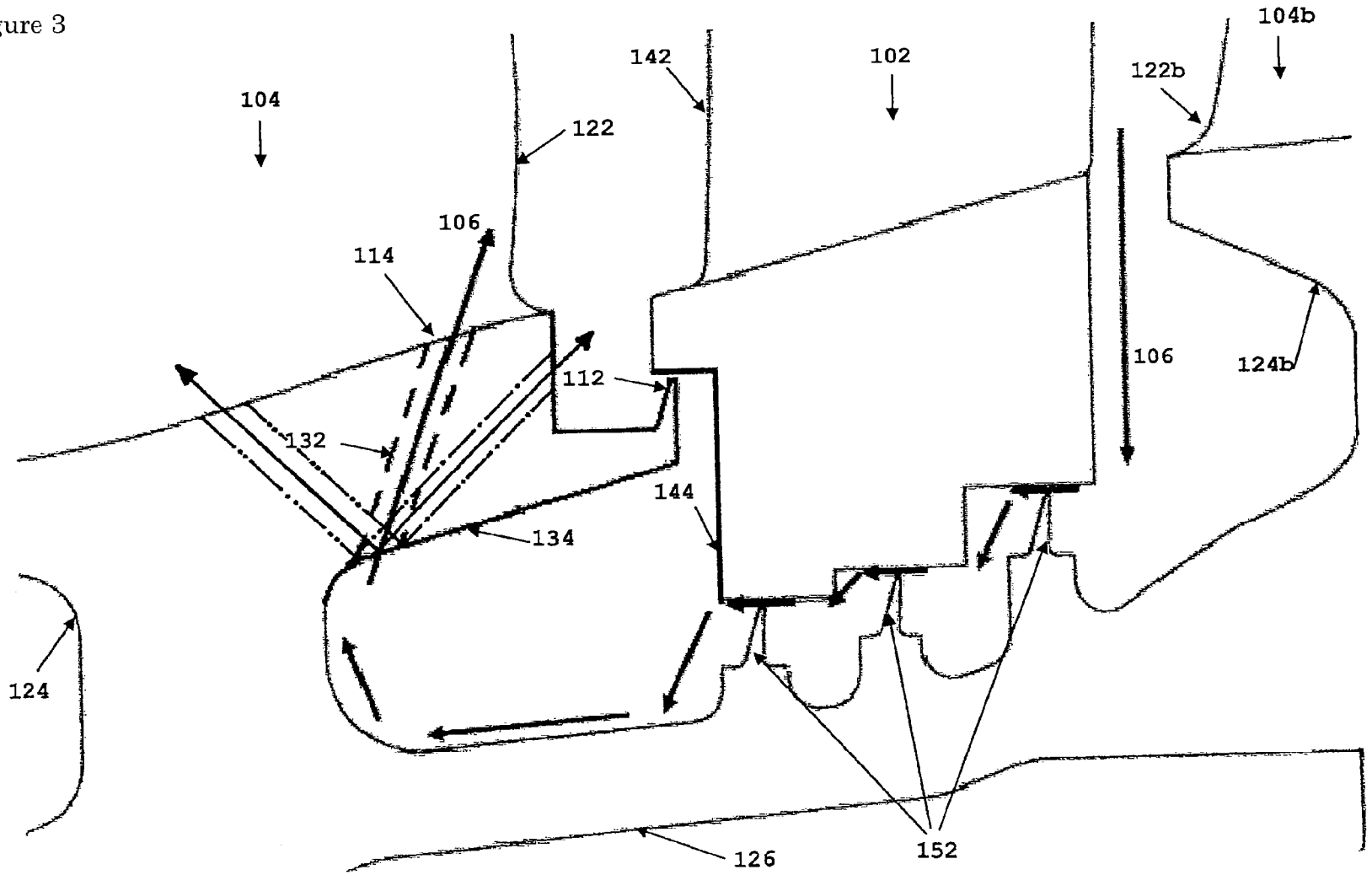
FIG. 3 is a schematic representation of another device according to the invention in a compressor.

FIG. 3 shows a schematic representation of the device according to the invention in accordance with a further exemplary embodiment of the present invention. The exemplary embodiment depicted in FIG. 3 differs from the exemplary embodiment shown in FIG. 1 in terms of the structural implementation of the channel 132 of the leakage current 106. Elements that do not differ from the exemplary embodiment depicted in FIG. 1 are not described again in the following.

According to the exemplary embodiment depicted in FIG. 3, the sealing element 112 again abuts a step of the stator inner cover band 144. However, in this case the step is configured such that the sealing element 112 seals the gap between the rotor platform 124 and the stator inner cover band 144 in the vicinity of the radially outer end of the stator inner cover band 144. In this way, a distance of the sealing element 112 to a radially outer end of the stator inner cover band 144 is less than a distance of the sealing element 112 to a radially inner end of the stator inner cover band 144. The leakage current 106 can be directed within a hollow space between the rotor shaft 126 and the extension 134 of the rotor platform 124 to the channel 132. According to this exemplary embodiment, the channel 132 may be designed as a borehole for a directed leakage flow. The outlet opening 114 of the channel 132 may be disposed on the hub surface and/or the front surface of the rotor platform 134, wherein a flow component against the main flow direction is also possible (see dashed, dashed-and-dotted and dashed-and-double-dotted lines).

Figure 4:
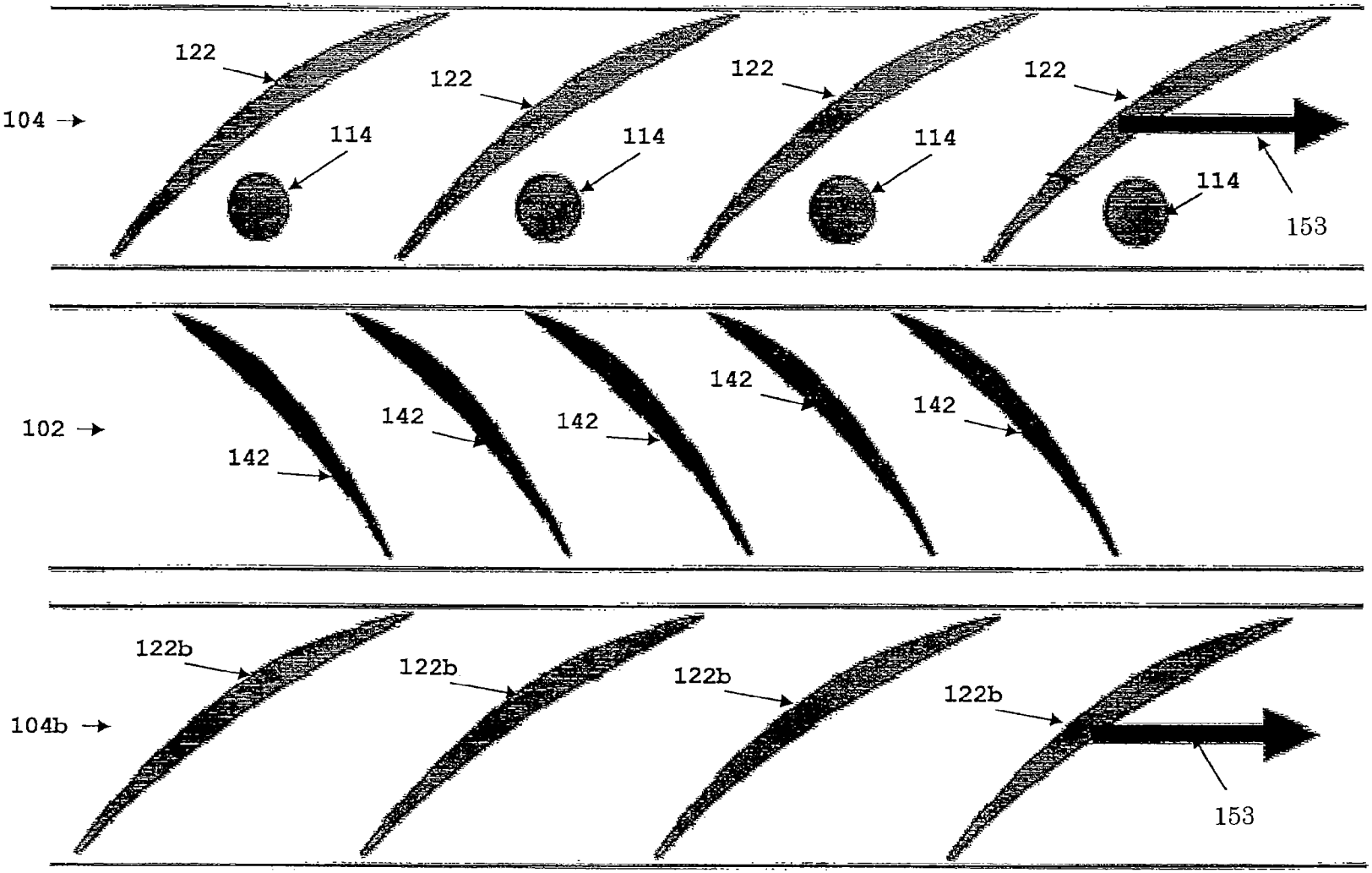
FIG. 4 is another schematic representation of the device depicted in FIG. 3.

Corresponding to FIG. 2, FIG. 4 is another schematic representation of the rotor 104 depicted in FIG. 3, of the stator 102 and of the other rotor 104*b*.

It is clear from FIG. 4 that the outlet openings 114 may have a round cross section in accordance with the exemplary embodiment depicted in FIG. 3. The outlet openings 114 may be disposed spaced apart from the edge of the rotor hub. In this case, a distance of the outlet openings 114 from an edge of the rotor hub facing away from the stator 102 may be greater than a distance of the outlet opening from an edge of the rotor hub facing the stator 102.

The method according to the invention renders the redirecting of the leakage current 106 possible, in that a flow of the leakage current 106 in the gap between the stator inner cover band 144 and rotor platform 124 is interrupted with the aid of the sealing element 112 and the leakage current is instead directed past the sealing element 112 to the outlet opening 114 disposed on the rotor 104.

In other words, leakage flows 106 may be introduced in the area of the inner air seals 152 further upstream. Thus, a redirecting of the leakage mass flow 106 through channels 116, 132 may take place which may lead under the last sealing tip 112 through to the openings 114 of rotor 104 located upstream. As a result, a circumference-discrete blowing process of the cavity mass flow 106 may be carried out via the rotor platform 124 of axial compressors to improve the flow quality at the stator hub.

If a compressor has a plurality of rotor/stator pairs, it is possible to use the approach according to the invention with each rotor/stator pair.

The depicted exemplary embodiments are selected merely by way of example and may be combined with one another. The described elements, the design thereof and the arrangement thereof may be modified within the bounds of the approach according to the invention. Likewise, a number and arrangement of outlet openings may be modified. In particular, those elements that make a variation and optimization of the injection direction of the leakage current possible are adaptable. The approach according to the invention for redirecting a leakage current is not restricted in this case to the described application in conjunction with an inner cover band of a stator, but may be used generally to guide leakage currents which arise in the boundary area between static and movable components.

The invention claimed is:

1. A compressor, comprising:

a rotor with a rotor platform and a plurality of rotor blades extending radially outwardly from the rotor platform, wherein the rotor platform includes an outlet opening;

a stator;

wherein the rotor is disposed upstream of the stator in relation to a main flow in the compressor; and a device for redirecting a leakage current flowing between the stator and the rotor, comprising:

a sealing element for interrupting the leakage current;

the outlet opening of the rotor platform; and a guide configured to direct the leakage current past the sealing element to the outlet opening.

2. The compressor according to claim 1, wherein the guide is configured to provide a defined injection direction for the leakage current at the outlet opening.

3. The compressor according to claim 1, wherein the guide has a channel leading through the rotor platform of the rotor, which channel is connected to the outlet opening.

4. The compressor according to claim 1, wherein the rotor has an extension which is configured to bridge a gap extending in a radial direction between the rotor and stator, wherein the sealing element is disposed on a stator-side end of the extension.

5. The compressor according to claim 4, wherein the guide is configured to direct the leakage current to go along between a rotor shaft of the rotor and the extension.

6. The compressor according to claim 1, wherein the sealing element abuts an inner cover band of the stator, wherein a distance of the sealing element to a radially outer end of the inner cover band is greater than or equal to a distance of the sealing element to a radially inner end of the inner cover band.

7. The compressor according to claim 1, wherein the sealing element abuts an inner cover band of the stator, wherein a distance of the sealing element to a radially outer end of the inner cover band is less than a distance of the sealing element to a radially inner end of the inner cover band.

8. The compressor according to claim 1, wherein the outlet opening is disposed in a hub surface and/or on a front surface of the rotor.

9. The compressor according to claim 8, wherein a distance of the outlet opening from an edge of the hub surface facing away from the stator is greater than a distance of the outlet opening from an edge of the hub surface facing the stator.

10. The compressor according to claim 8, wherein the outlet opening is disposed on an edge of the hub surface facing the stator.

11. The compressor according to claim 1, wherein the outlet opening is disposed between two rotor blades of the rotor, wherein the outlet opening is disposed closer to one of the two rotor blades which, in relation to a rotational direction of the rotor, is disposed behind the outlet opening.

12. The compressor according to claim 1, wherein the outlet opening has a round cross-section.

13. The compressor according to claim 1, wherein the outlet opening is configured as a slot.

* * * * *